US006653775B1

(12) United States Patent
Speer et al.

(10) Patent No.: US 6,653,775 B1
(45) Date of Patent: Nov. 25, 2003

(54) FLUORESCENT LAMP AND AMALGAM ASSEMBLY THEREFOR

(75) Inventors: Richard S. Speer, Concord, MA (US); Louise D. Cleary, Salem, MA (US); Joseph V. Lima, Salem, MA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 10/226,556

(22) Filed: Aug. 23, 2002

(51) Int. Cl.[7] ..... H01J 1/62; H05B 41/24

(52) U.S. Cl. ..... 313/490; 315/248

(58) Field of Search ..... 315/248, 57; 313/267, 313/492, 493, 489, 545, 550, 565, 490

(56) References Cited

U.S. PATENT DOCUMENTS

| | | | | | |
|---|---|---|---|---|---|
| 4,035,682 | A | | 7/1977 | Bubar | 313/174 |
| 4,393,325 | A | | 7/1983 | van der Kooi | 313/552 |
| 4,528,209 | A | | 7/1985 | Anderson et al. | 427/67 |
| 5,434,482 | A | | 7/1995 | Borowiec et al. | 315/248 |
| 5,629,584 | A | * | 5/1997 | Borowiec et al. | 313/565 |
| 5,723,947 | A | * | 3/1998 | Popov et al. | 313/634 |
| 5,767,617 | A | | 6/1998 | Wharmby et al. | 313/489 |
| 5,773,926 | A | * | 6/1998 | Maya et al. | 313/490 |
| 5,841,229 | A | * | 11/1998 | Borowiec et al. | 313/490 |
| 5,994,837 | A | | 11/1999 | Willems et al. | 313/550 |
| 6,097,137 | A | | 8/2000 | Forsdyke et al. | 313/161 |

* cited by examiner

*Primary Examiner*—Don Wong
*Assistant Examiner*—Minh D A
(74) *Attorney, Agent, or Firm*—Carlo Bessone

(57) ABSTRACT

An amalgam assembly for a fluorescent lamp includes a glass exhaust tubulation extending toward a base portion of the lamp, the tubulation being closed at an end adjacent the lamp base portion, and a metal cup disposed in the tubulation and retained by a pinched portion of the tubulation. The cup defines an annular outer wall having a free edge extending toward the tubulation closed end, a tubular central core portion extending toward the tubulation closed end, and an annular trough formed by the core portion and the outer wall. A mercury amalgam ball is disposed between the metal cup and the tubulation closed end, a diameter of the ball exceeding an inner diameter of the core portion, and a coating of a metal wetting agent is disposed on interior surfaces of the trough.

18 Claims, 2 Drawing Sheets

FLUORESCENT LAMP AND AMALGAM ASSEMBLY THEREFOR

BACKGROUND OF THE INVENTION

1. Field of the Invention

This invention relates to fluorescent lamps and is directed more particularly to an amalgam assembly including an improved amalgam retainer for use within an exhaust tubulation of a fluorescent lamp.

2. Description of the Prior Art

The light output of fluorescent lamps is critically dependent upon mercury vapor pressure (vapor density) within the lamp envelope. The mercury vapor pressure, in turn, is controlled by the temperature of excess liquid mercury which condenses in the coldest part of the lamp envelope, the so-called "cold spot". Fluorescent lamps typically include at least one tubulation that has an opening into the interior of the lamp envelope and which, in construction of the lamp, is used as an exhaust and fill tubulation. At completion of manufacture, the exhaust tubulation is hermetically tipped off and the tipped end typically becomes the lamp "cold spot".

The amalgam is commonly located in the exhaust tubulation cold spot. Such amalgams reduce the mercury vapor pressure relative to that of pure mercury at any given temperature and thereby permit optimum light output at elevated temperatures. Such amalgams also provide a broadened peak in the light output versus temperature curve, so that near optimum light output is obtained over an extended range of ambient temperatures.

When lamps are operated at temperatures lower or higher than the optimum ambient temperature, light output decreases by as much as 30% or more relative to peak value. This is a common occurrence when lamps are operated in enclosed or semi-enclosed fixtures. In addition to reduced light output, the color of the light varies as a result of the varying contribution of blue spectral emission from the mercury vapor in the discharge.

The problem of mercury vapor pressure control under varying temperature conditions is solved, at least in part, through the use of various alloys capable of absorbing mercury from its gaseous phase. Alloys of low temperature melting metals are often placed within fluorescent lamps to amalgamate with the excess mercury, and to regulate the mercury vapor pressure within the lamp. Alloys known to be particularly useful in forming amalgams with mercury include a lead-bismuth-tin alloy, a bismuth-indium alloy, a bismuth and tin alloy, and a zinc, indium and tin alloy. Other useful amalgams may be formed with pure indium, pure lead, and pure zinc.

The lamp typically is provided with an excess amount of mercury amalgam, that is, more amalgam than is needed to supply the mercury vaporized when the lamp reaches a stabilized operating condition. As the lamp ages, some of the excess amalgam is required to replace the mercury chemically bound elsewhere in the lamp during the life of the lamp.

When an amalgam fluorescent lamp is turned off, the amalgam cools and the mercury vapor within the lamp is gradually absorbed into the amalgam. When the lamp is turned on, the lumen output is significantly reduced until the amalgam is warmed up to a point at which the amalgam emits sufficient mercury vapor to permit efficient lamp operation.

In some types of lamps, particularly electrodeless fluorescent lamps, it is important that the amalgam be prevented from settling within the arc environment in the lamp envelope where the amalgam can cause deleterious changes in the lumen output and the lumen-temperature performance of the lamp.

In base-up lamps, there has been a particular problem in that in use the sealed end of the tubulation is pointed upwardly and the end of the tubulation that opens into the lamp envelope is disposed downwardly of the amalgam, and the amalgam has tended to drop by gravity downwardly into the lamp envelope, where a much higher temperature is present, causing a sudden rise in mercury vapor pressure and an increase in lamp voltage, resulting in the occurrence of black spots on the glass envelope. If the lamp voltage exceeds the maximum sustaining voltage of the ballast provided in the lamp, the lamp extinguishes. There is thus required a means for retaining liquid amalgam in the tubulation, but permitting mercury vapor to exit the tubulation and flow into the lamp envelope.

Accordingly, there is a need for an amalgam assembly including an amalgam retainer for limiting the amalgam to the tubulation sealed end region.

SUMMARY OF THE INVENTION

An object of the invention is, therefore, to provide an amalgam assembly featuring an improved retainer for disposition in an exhaust tubulation of a fluorescent lamp to prevent migration of liquid amalgam into the lamp envelope.

A further object of the invention is to provide an electrodeless fluorescent lamp having therein an amalgam assembly featuring an improved amalgam retainer.

With the above and other objects in view, as will hereinafter appear, a feature of the present invention is the provision of an amalgam assembly for a fluorescent lamp. The assembly comprises a glass exhaust tubulation extending toward a base portion of the lamp, the tubulation being closed at an end adjacent the base portion. A metal cup is disposed in the tubulation and is retained by a pinched portion of the tubulation. The cup defines an annular outer wall having a free edge extending toward the tubulation closed end, a tubular central core portion extending toward the tubulation closed end, and an annular trough formed by the core portion and the outer wall. A mercury amalgam ball is disposed between the metal cup and the tubulation closed end, a diameter of the ball exceeding an inner diameter of the core portion, and a coating of a metal wetting agent is disposed on interior surfaces of the trough. When the amalgam body liquidizes, the liquid amalgam adheres to the cup trough surfaces and mercury vapor is flowable through the cup core portion.

In accordance with a further feature of the invention, there is provided an electrodeless fluorescent lamp comprising a light-transmissive envelope containing an ionizable, gaseous fill for sustaining an arc discharge when subjected to a radio frequency magnetic field and for emitting ultraviolet radiation as a result thereof. The envelope is provided with an interior phosphor coating for emitting visible radiation when excited by the ultraviolet radiation, and with a re-entrant cavity formed therein. An excitation coil is contained within the re-entrant cavity for providing the radio frequency magnetic field when excited by a radio frequency power supply. An exhaust tubulation extends through the re-entrant cavity and into the envelope for evacuating and filling the lamp in manufacture, the exhaust tubulation extending toward a base portion of the lamp and having a closed end proximate the lamp base portion. A dimple configuration is formed in the exhaust tubulation at a predetermined distance from the tubulation closed end. A metal cup retains an amalgam in a location in the exhaust tubulation between the metal cup and the closed end of the exhaust tubulation, the metal cup defining an annular wall having a free edge extending toward the exhaust tubulation closed end, a tubular central core portion extending toward the exhaust tubulation closed end, and an annular trough formed by the core portion and the outer wall. A coating of a metal wetting agent is disposed on interior surfaces of the trough. When the amalgam body liquidizes, the liquid amalgam adheres to the cup trough surfaces and mercury vapor is flowable through the cup core portion.

The above and other features of the invention, including various novel details of construction and combinations of parts, will now be more particularly described with reference to the accompanying drawings and pointed out in the claims. It will be understood that the particular devices embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENT

Figure 1:
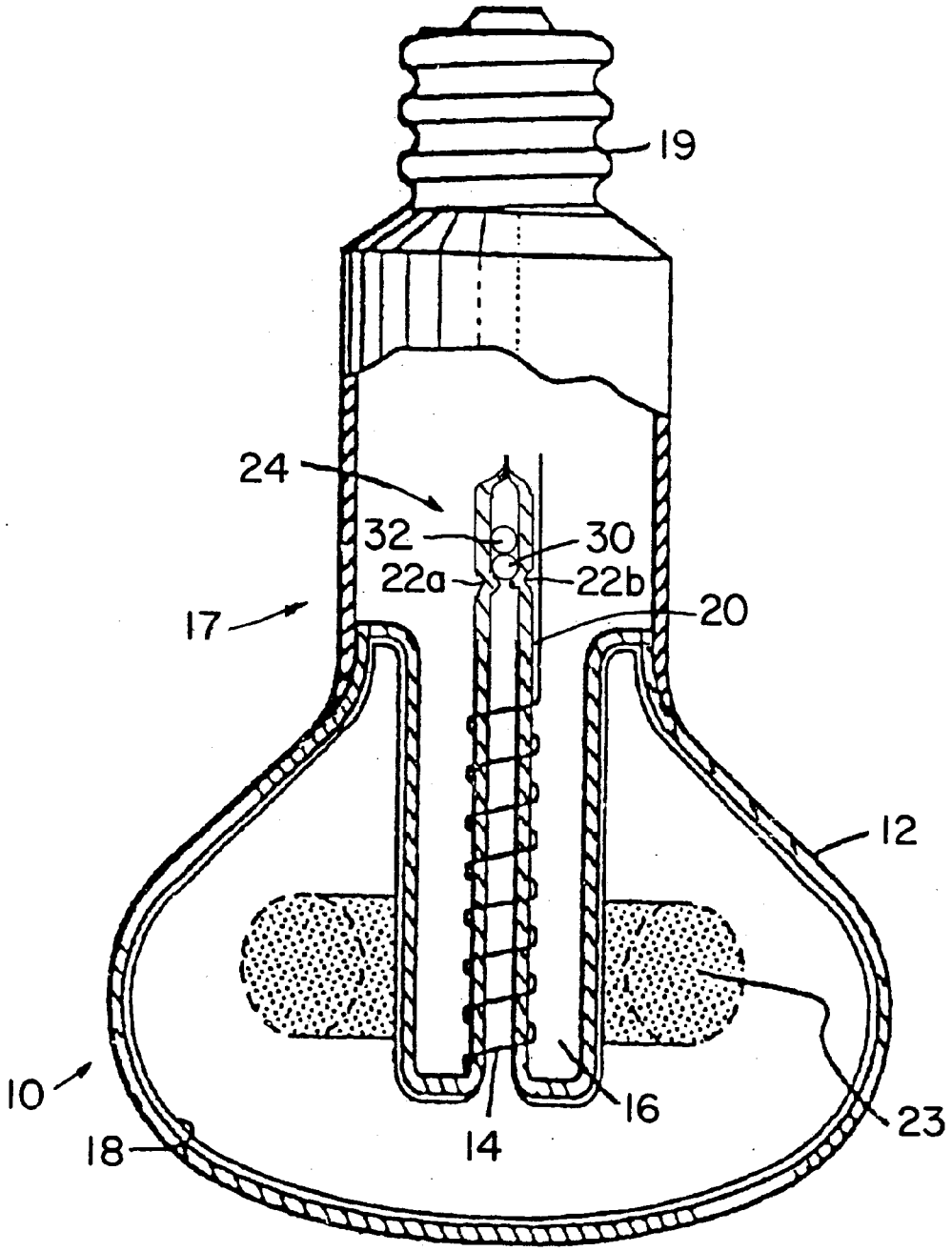
FIG. 1 PRIOR ART
FIG. 1 is an elevational broken-away and partly sectional view of a prior art electrodeless fluorescent lamp.

Referring to FIG. 1, it will be seen that a known base-up compact fluorescent lamp 10 is provided with a light-transmissive envelope 12 containing an ionizable gaseous fill for sustaining an arc discharge. In manufacture, the lamp 10 is dosed with the fill via an exhaust tubulation 20 in well-known manner. A suitable fill, for example, comprises a mixture of a rare gas (e.g., krypton and/or argon) and mercury vapor. An excitation coil 14 is situated within, and removable from, a re-entrant cavity 16 within the envelope 12. For purposes of illustration, the coil 14 is shown schematically as being wound about the exhaust tubulation 20. However, the coil 14 may be spaced apart from the exhaust tubulation 20 and wound about a core of insulating material (not shown), or may be free standing (not shown), as desired. The interior surfaces of the envelope 12 are coated in well-known manner with a suitable phosphor 18. The envelope 12 fits into one end of a base assembly 17 containing a radio frequency power supply (not shown) with a standard (e.g., Edison type) lamp base 19.

A mercury amalgam body 32 is placed and retained in a location optimized for the particular amalgam in a particular lamp. Each amalgam has its own optimum range of operating temperatures to provide a suitable mercury vapor pressure.

An indentation, or dimple, 22 is situated toward a tip-off region of the exhaust tubulation 20. The tip-off region is the area at the top of the exhaust tubulation which is sealed, or "tipped off" to form the closed end 24 of the exhaust tubulation after evacuating and filling the lamp therethrough.

After the lamp is evacuated and filled through the exhaust tubulation 20, an appropriately sized and shaped dose locating member, preferably comprising a glass ball 30, is inserted into the exhaust tubulation 20 through the opening at the tip-off region. By virtue of the presence of the dimple 22 and the size and shape of glass ball 30, the dose locating member remains on the side of the dimple away from the re-entrant cavity 16. The amalgam 32 is then inserted into the exhaust tubulation 20 through the opening in the tip-off region. The combination of dimple 22 and glass ball 30 results in placement and retention of the amalgam 32 at a predetermined location. As noted above, the exhaust tubulation is tipped-off above the amalgam 32 to provide the tubulation closed end 24.

In operation, current flows in the coil 14 as a result of excitation by the radio frequency power supply. A radio frequency magnetic field is thereby established within the envelope 12 which ionizes and excites the gaseous fill contained therein, resulting in a toroidal discharge 23 and emission of ultraviolet radiation therefrom. The phosphor 18 absorbs the ultraviolet radiation and emits visible radiation.

It has been found, however, that in base-up lamps the glass ball type of locating member 30 sometimes fails to retain liquidized amalgam in the upper region of the tubulation. As noted hereinabove, escape of the amalgam from the tubulation closed end region and into the envelope can lead to lamp failure.

Figure 2:
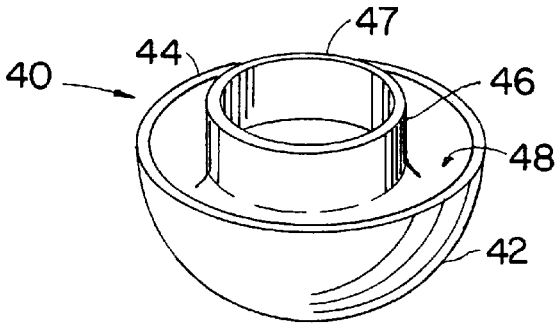
FIG. 2 is a perspective view of an improved retainer for preventing movement of liquid amalgam from the preferred amalgam location in a lamp of the type shown in FIG. 1.

Referring to FIG. 2, it will be seen that in accordance with the present invention there is provided an amalgam retainer comprising a metal cup 40 disposed in the glass tubulation 20 (FIG. 3) and retained by at least one pinched portion 22 of the tubulation.

The cup 40 defines an annular outer wall 42 having a free edge 44 extending toward the tubulation closed end 24. The cup 40 further defines a tubular central core portion 46 extending toward the tubulation closed end 24. The core portion 46 is provided with a free edge 47 which extends toward the tubulation closed end 24 further than the cup outer wall free edge 44. An annular trough 48 is formed by the core portion 46 and the outer wall 42.

The cup 40 is provided with a coating of metal wetting agent disposed on surfaces of the trough 48 opposed to the tubulation closed end 24. Appropriate coatings to serve as wetting agents include silver and indium. The cup 40 fits snugly in the tubulation and the peripheral outer walls 42 of the cup 40 engage the inner walls of the tubulation. Preferably, the metal cup 40 exhibits a leaf spring like quality, the walls 42 being thereby biased into engagement with the tubulation inner walls. Stainless steel and iron-nickel alloys have been found to be suitable materials for the cup 40.

Figure 3:
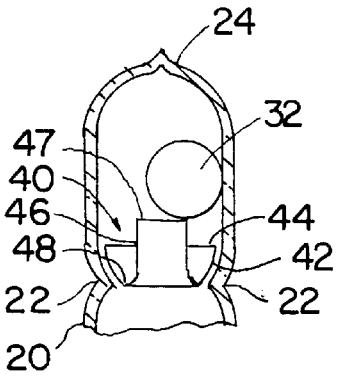
FIG. 3 is a diagrammatic illustration of the retainer of FIG. 2 disposed in an exhaust tubulation portion of a fluorescent lamp of the type shown in FIG. 1.

The mercury amalgam body 32 is disposed between the metal cup 40 and the exhaust tubulation closed end 24, as shown in FIG. 3. The amalgam body 32 is generally spherically shaped and provided with a diameter exceeding the inside diameter of the core portion 46 of the cup 40.

When the lamp is completed and placed in operation, the amalgam body 32 liquidizes and is attracted to the cup trough 48 by the wetting agent therein. Thus, the liquid amalgam occupies the trough in an annular arrangement, while mercury vapor is allowed to pass through the cup core portion.

Figure 4:
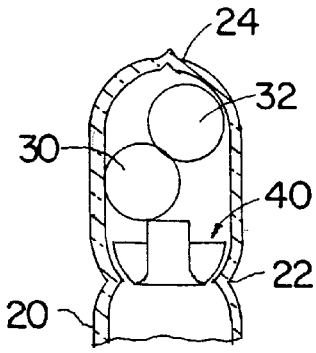
FIG. 4 is similar to FIG. 3, but illustrative of an alternative embodiment.

Referring to FIG. 4, it will be seen that the metal cup 40 may be used in combination with one or more glass balls 30, such that the glass ball 30 serves its usual function of retaining the liquid amalgam but is, in effect, "backed up" by the metal cup 40 which attracts and retains any amalgam that gets by the glass ball.

It will be understood that many additional changes in the details, materials, and arrangement of parts, which have been herein described and illustrated in order to explain the nature of the invention, may be made by those skilled in the art within the principles and scope of the invention as expressed in the appended claims.

What is claimed is:

1. An amalgam assembly for a fluorescent lamp, the assembly comprising:

a glass exhaust tubulation extending toward a base portion of the lamp, said tubulation being closed at an end adjacent the base portion;

a metal cup disposed in said tubulation and retained by a pinched portion of said tubulation, said cup defining a trough open towards the tubulation closed end and an aperture extending through said cup;

a mercury amalgam body disposed in said tubulation between said metal cup and the tubulation closed end; and a coating of a metal wetting agent disposed on surfaces of the trough opposed to the tubulation closed end;

whereby when said amalgam body liquidizes, the liquid amalgam adheres to the cup trough surfaces and mercury vapor is flowable through the cup aperture.

2. The amalgam assembly in accordance with claim 1 wherein said metal cup snugly fits in said tubulation and peripheral walls of said cup are engaged with interior walls of said tubulation.

3. The amalgam assembly in accordance with claim 2 wherein said cup is of a metal having sufficient springiness to bias the cup peripheral walls against the interior walls of the tubulation.

4. The amalgam assembly in accordance with claim 3 wherein said cup is of a metal selected from (i) stainless steel and (ii) iron-nickel alloy.

5. The amalgam assembly in accordance with claim 1 wherein said cup trough comprises an annular trough defined by a cup outer wall having a free edge extending toward the tubulation closed end, and by a cup tubular central core portion defining the aperture and extending toward the tubulation closed end.

6. The amalgam assembly in accordance with claim 5 wherein the metal wetting agent is disposed in the annular trough and comprises a selected one of (i) silver and (ii) indium.

7. The amalgam assembly in accordance with claim 5 wherein said cup core portion extends closer to the tubulation closed end than does the cup outer wall.

8. The amalgam assembly in accordance with claim 1 wherein said amalgam body is generally spherically shaped and is provided with a diameter exceeding an inner diameter of the core portion aperture.

9. The amalgam assembly in accordance with claim 1 wherein the metal wetting agent comprises a selected one of (i) silver and (ii) indium.

10. The amalgam assembly in accordance with claim 1 and further comprising a glass ball disposed in said tubulation between said metal cup and the tubulation closed end.

11. An amalgam assembly for a fluorescent lamp, the assembly comprising:

a glass exhaust tubulation extending toward a base portion of the lamp, said tubulation being closed at an end adjacent the base portion;

a metal cup disposed in said tubulation and retained by a pinched portion of said tubulation, said cup defining an annular outer wall having a free edge extending toward the tubulation closed end, a tubular central core portion extending toward the tubulation closed end, and an annular trough formed by said core portion and the outer wall;

a mercury amalgam ball disposed between said metal cup and the tubulation closed end, a diameter of said ball exceeding an inner diameter of said core portion; and a coating of a metal wetting agent disposed on interior surfaces of said trough;

whereby when said amalgam body liquidizes, the liquid amalgam adheres to the wetting agent in the cup trough and mercury vapor is flowable through the cup core portion.

12. An electrodeless fluorescent lamp, comprising:

a light-transmissive envelope containing an ionizable, gaseous fill for sustaining an arc discharge when subjected to a radio frequency magnetic field and for emitting ultraviolet radiation as a result thereof, said envelope having an interior phosphor coating for emitting visible radiation when excited by the ultraviolet radiation, said envelope having a re-entrant cavity formed therein;

an excitation coil contained within the re-entrant cavity for providing the radio frequency magnetic field when excited by a radio frequency power supply;

an exhaust tubulation extending through the re-entrant cavity and into said envelope for evacuating and filling said lamp, said exhaust tubulation having a closed end proximate a base portion of the lamp;

a dimple configuration formed in said exhaust tubulation at a predetermined distance from the tubulation closed end;

a mercury amalgam body disposed in said tubulation;

a metal cup for retaining said amalgam body in a location in said exhaust tubulation between said metal cup and the closed end of said exhaust tubulation, said metal cup defining an annular wall having a free edge extending toward the exhaust tubulation closed end, a tubular central core portion extending toward the exhaust tubulation closed end, and an annular trough formed by the core portion and the outer wall; and a coating of a metal wetting agent disposed on interior surfaces of the trough;

whereby when said amalgam body liquidizes, the liquid amalgam adheres to the cup trough surfaces, and mercury vapor is flowable through the cup core portion.

13. The lamp in accordance with claim 12 wherein said metal cup snugly fits in said tubulation and peripheral walls of said cup are engaged with interior walls of said tubulation.

14. The lamp in accordance with claim 13 wherein said cup is of a metal having sufficient springiness to bias the cup peripheral walls against the interior walls of the tubulation.

15. The lamp in accordance with claim 14 wherein said cup is of a metal selected from (i) stainless steel and (ii) iron-nickel alloy.

16. The lamp in accordance with claim 12 wherein the metal wetting agent comprises a selected one of (i) silver and (ii) indium.

17. The lamp in accordance with claim 12 wherein said cup core portion extends closer to the tubulation distal end than the cup outer wall.

18. The lamp in accordance with claim 12 and further comprising a glass ball disposed in said exhaust tubulation between said metal cup and the closed end of said exhaust tubulation.

* * * * *